US012172092B2

(12) United States Patent
Devalal

(10) Patent No.: US 12,172,092 B2
(45) Date of Patent: Dec. 24, 2024

(54) MEXICAN TRAIN DOMINOES GAME KIT AND ASSEMBLY

(71) Applicant: Ian Devalal, New Palestine, IN (US)

(72) Inventor: Ian Devalal, New Palestine, IN (US)

( * ) Notice: Subject to any disclaimer, the term of this patent is extended or adjusted under 35 U.S.C. 154(b) by 597 days.

(21) Appl. No.: 17/515,620

(22) Filed: Nov. 1, 2021

(65) Prior Publication Data

US 2023/0132650 A1 May 4, 2023

(51) Int. Cl.
*A63F 9/20* (2006.01)

(52) U.S. Cl.
CPC ..... *A63F 9/20* (2013.01)

(58) Field of Classification Search
CPC .. A63F 9/20; A63F 1/062; A63F 1/067; A63F 1/10; A63F 3/00176; A63F 3/0023; A63F 3/00261; A63F 2003/00201; A63F 2003/00359
USPC ..... 273/292, 293, 294, 309, 148 R, 148 A
See application file for complete search history.

(56) References Cited

U.S. PATENT DOCUMENTS 1,484,472 A * 2/1927 Cowen ..... A63F 1/10 273/150
3,702,703 A * 11/1972 Du Bois ..... A63F 9/20 235/90
6,164,648 A * 12/2000 Everett ..... A63F 9/20 D21/392
6,168,156 B1 * 1/2001 Gonzalez ..... A63F 9/20 273/148 R
6,176,490 B1 * 1/2001 Brown ..... A63F 9/20 273/293

(Continued)

*Primary Examiner* — Joseph B Baldori
(74) *Attorney, Agent, or Firm* — David E. Novak; Brannon Sowers & Cracraft PC

(57) ABSTRACT

A Mexican Train dominoes kit, including a top portion having a plurality of top edges, a bottom portion having a plurality of bottom edges and spaced from the top portion, and a plurality of elongated side portions operationally connectable to respective spaced top and bottom portions for defining an interior volume. Each respective elongated side portion further includes a top surface and an oppositely disposed bottom surface, a plurality of first elongated grooves formed in the top surface, a plurality of second grooves formed in the bottom surface, first and second oppositely disposed elongated side surfaces, and first and second matable connectors operationally connected to respective first and second elongated side surfaces, wherein each respective first matable connector is removably connectable to each respective second matable connector. The kit further includes a roundhouse portion removably connectable to the top portion, wherein the roundhouse portion further defines a generally circular base member, a plurality of slots formed equidistantly around the generally circular base member, a raised dais operationally connected to the generally circular base member, a plurality of recesses formed in the generally circular base member, each respective recess extending from a respective slot to the dais, a plurality of elongated train tokens operationally connected to the raised dais, each respective elongated train token extendable into a respective recess, and a cap member covering the dais and having a recess formed therein for accepting a domino. The kit also includes a plurality of dominoes and a handle portion for lockingly engaging one or more respective first elongated groove.

11 Claims, 7 Drawing Sheets

(56) References Cited

U.S. PATENT DOCUMENTS

| | | | | |
|---|---|---|---|---|
| 6,213,467 | B1 * | 4/2001 | Andrews | A63F 9/20 463/11 |
| 6,517,070 | B1 * | 2/2003 | Clapera | A63F 9/20 D21/392 |
| D484,922 | S * | 1/2004 | Voigt, IV | D21/392 |
| 6,854,730 | B2 * | 2/2005 | Braun | A63F 3/00574 273/148 A |
| 7,080,837 | B2 * | 7/2006 | Voigt, IV | A63F 9/20 D21/392 |
| D686,672 | S * | 7/2013 | Davis | D21/392 |
| 10,118,090 | B1 * | 11/2018 | Gonzalez | A63F 9/20 |
| D992,036 | S * | 7/2023 | Wu | D21/392 |
| 2005/0051954 | A1 * | 3/2005 | Scott | A63F 9/24 273/148 R |
| 2006/0119038 | A1 * | 6/2006 | Crotteau | A63F 9/20 273/148 R |
| 2013/0328264 | A1 * | 12/2013 | Ponce | A63F 9/20 273/148 R |

* cited by examiner

MEXICAN TRAIN DOMINOES GAME KIT AND ASSEMBLY

BACKGROUND

It is important to learn basic concepts such as pattern recognition, basic mathematics, spatial relationships, and how to deal with setbacks in a mature and sportsmanlike manner. As these simple skills are mastered, more complex skills may be acquired, such as how to plan competitive strategies and how to take advantage of opportunities as they present themselves.

One way of acquiring such basic skills is through the playing of educational games that make the learning process fun and entertaining. One such game is Mexican train dominoes. Mexican train is a dominoes variant with the object being for a player to play all of the domino tiles in his hand onto one or more 'trains' (domino chains) that branch out from a central 'roundhouse'. While there are a vast number of rules variants, most include a central community 'Mexican train' that may be used by all players. Each player's 'train' is usually identified by a small, typically color-coded, locomotive figurine.

While quite popular, the game does have a few drawbacks. First, a lot of dominoes are required for multi-player games. Also, the tiny locomotives are a choking hazard for very young players. Further, it may be hard for younger players or those with poor finger coordination to hold all of the dominoes in their hand. Hence, there is a need for an improved portable Mexican train dominoes game capable of storing and transporting the requisite number of dominoes while providing means for privately displaying all of the dominoes in a player's hand to the player and addressing the issue of the tiny locomotive choking hazard so as to be safely and easily played by anyone, including young children. A means for satisfying this need has so far eluded those skilled in the art.

DETAILED DESCRIPTION

Figure 1:
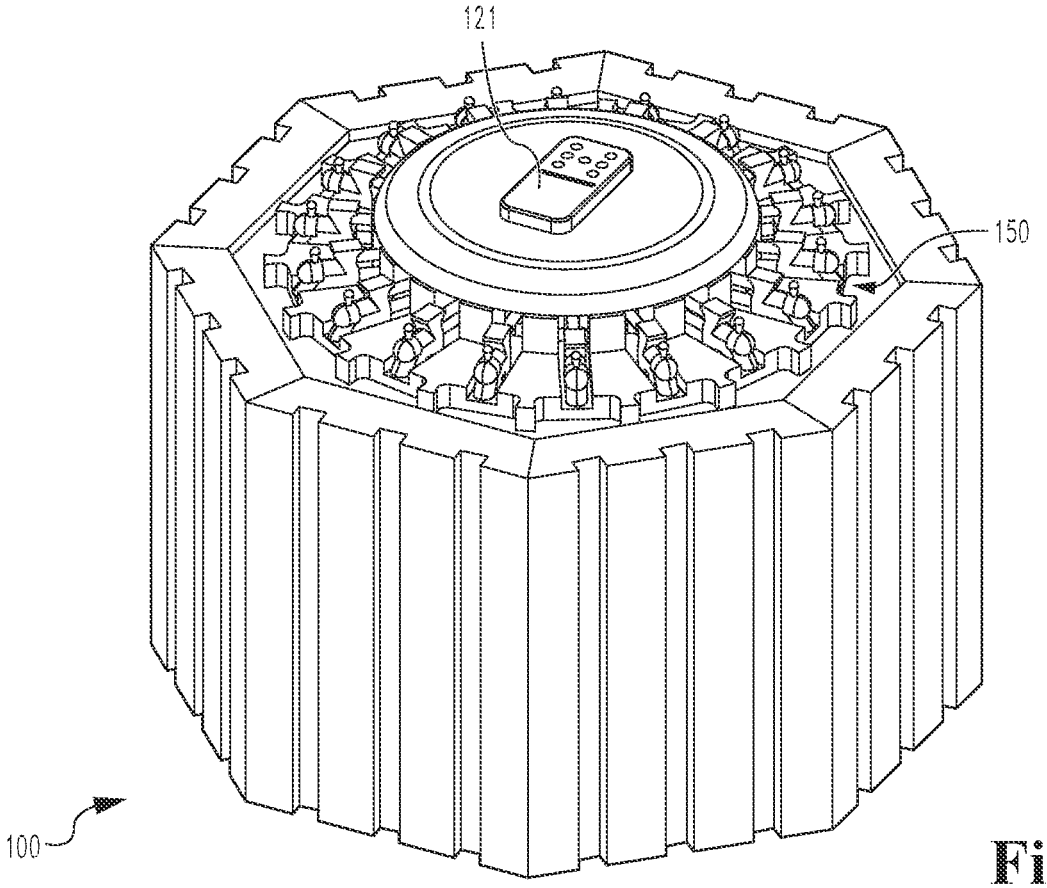
FIG. 1 is a perspective view of a first embodiment container of the present novel technology.
Figure 2:
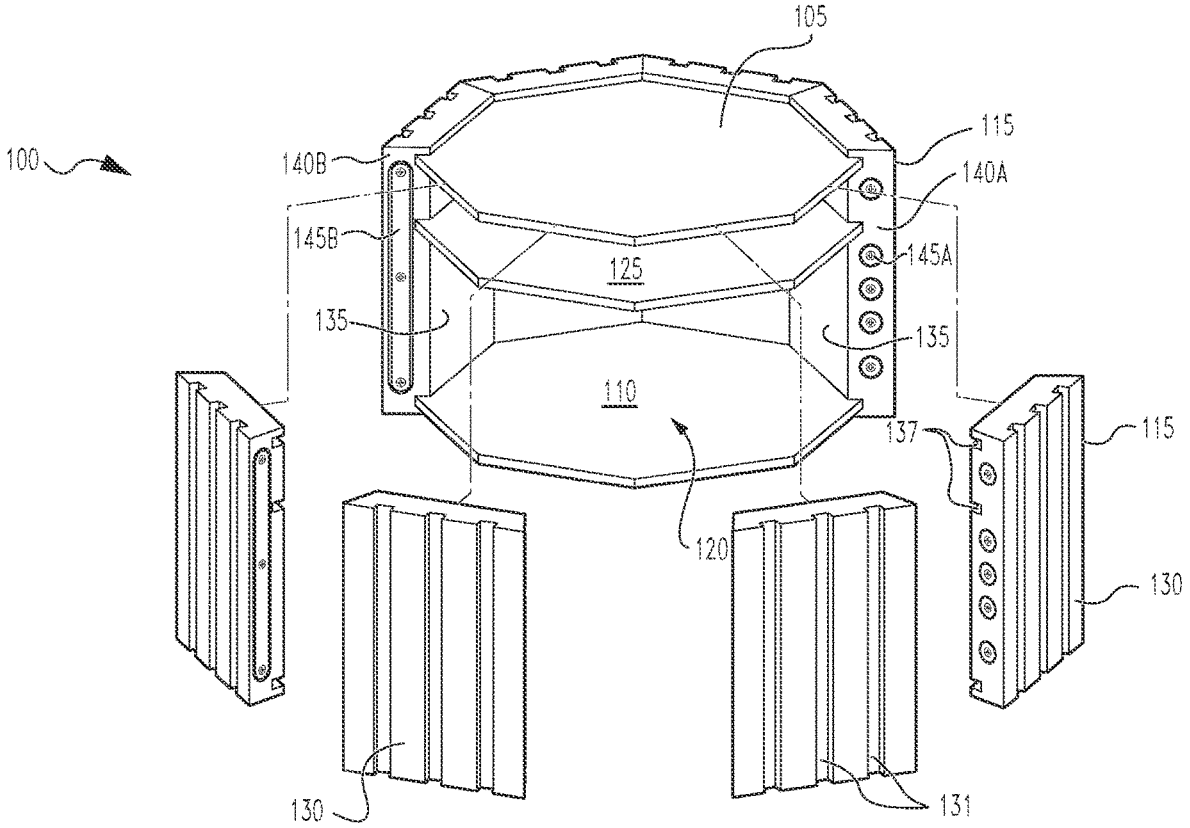
FIG. 2 is a side perspective view of the container of FIG. 1 partially disassembled with removed side members visible.
Figure 3:
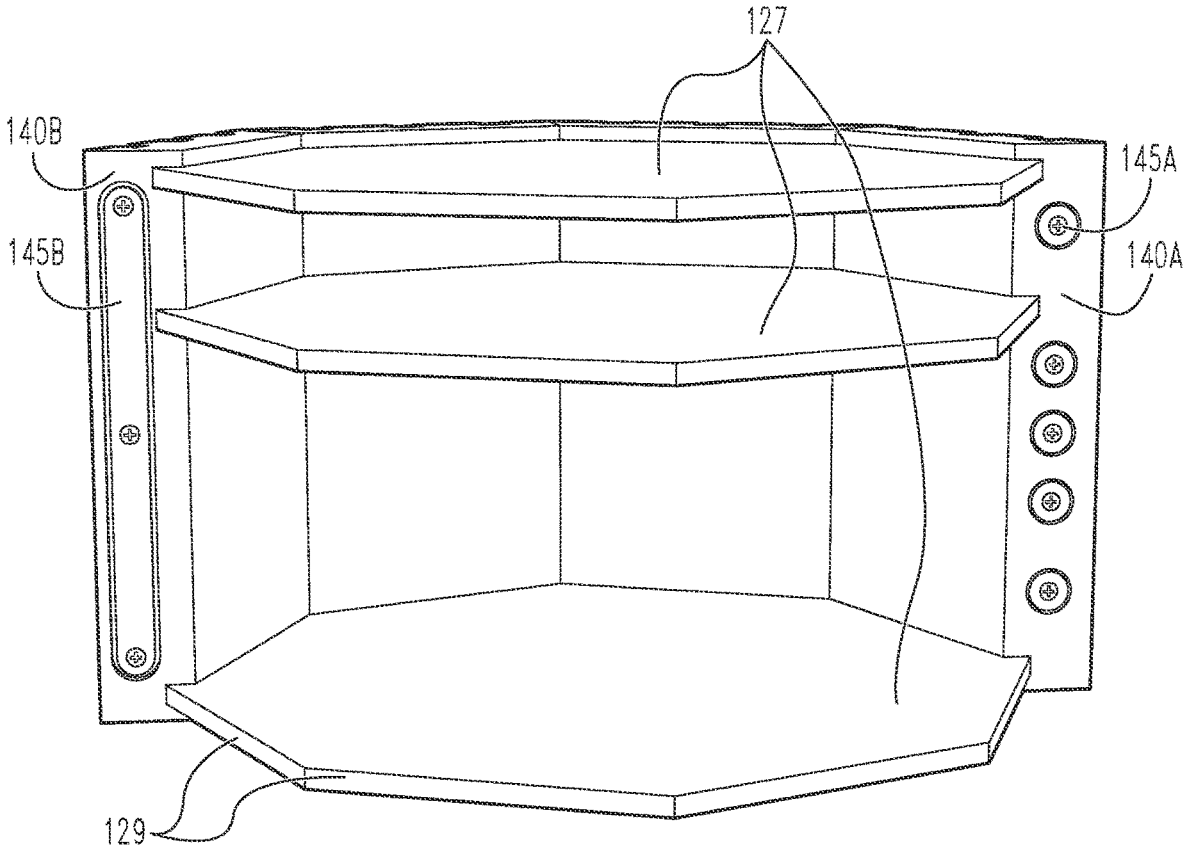
FIG. 3 is a side perspective view of the container of FIG. 1 partially disassembled.
Figure 5:
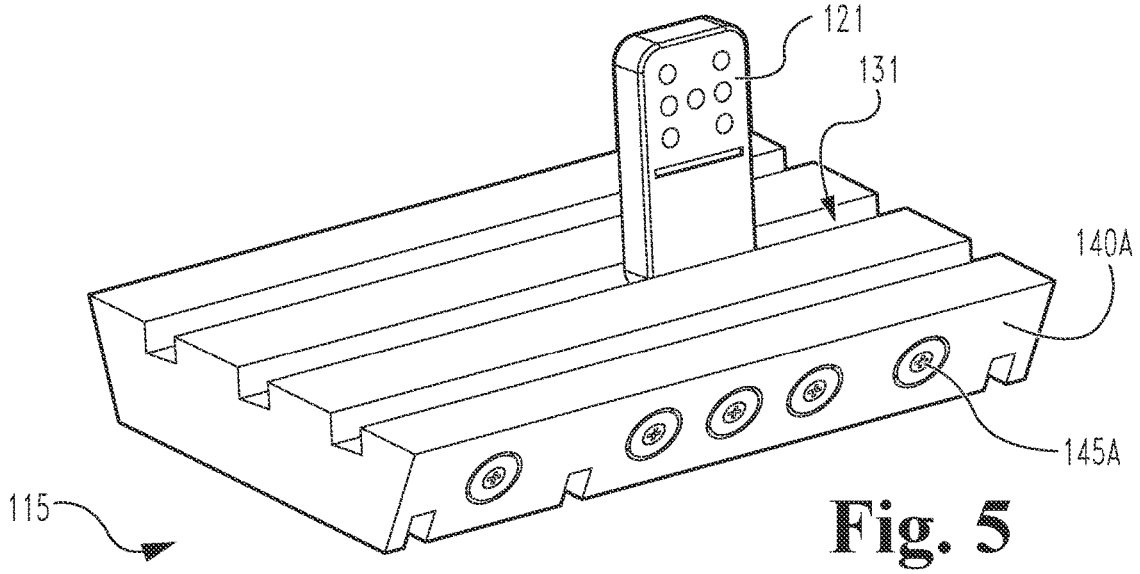
FIG. 5 is a perspective view of the exterior surface of an elongated side member with a domino engaged in an exterior groove.
Figure 4:
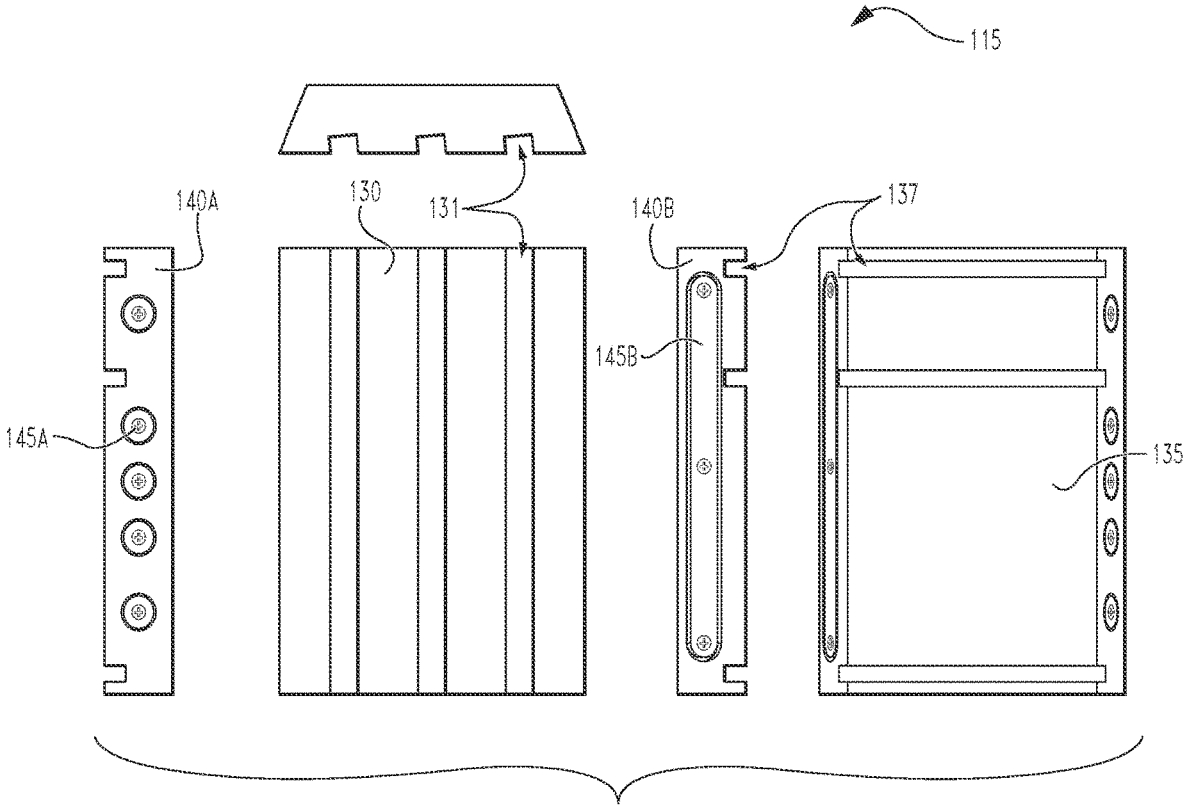
FIG. 4 is a top plan view of elongated side members of FIG. 1.
Figure 6:
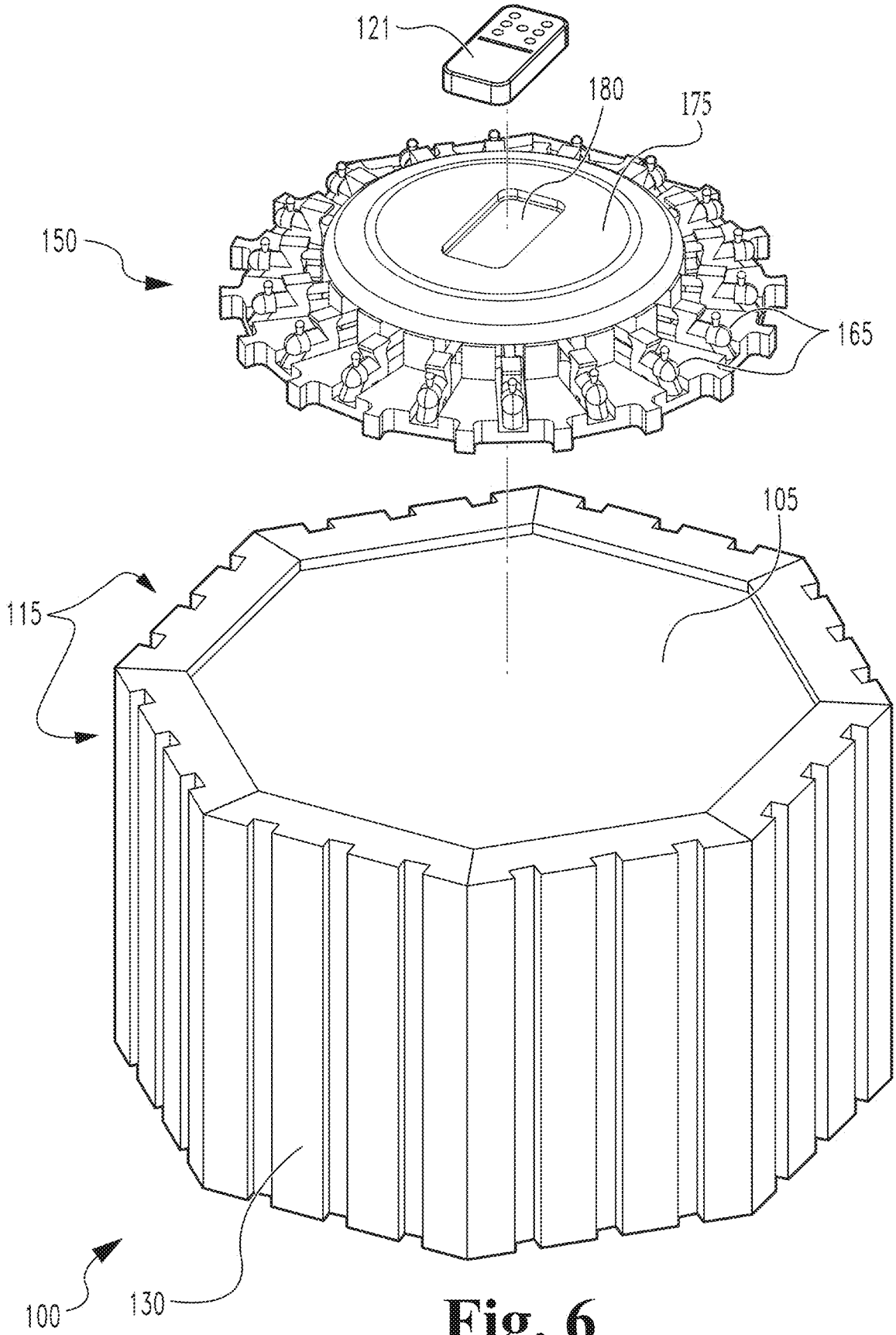
FIG. 6 is an exploded perspective view of the container of FIG. 1.
Figure 7:
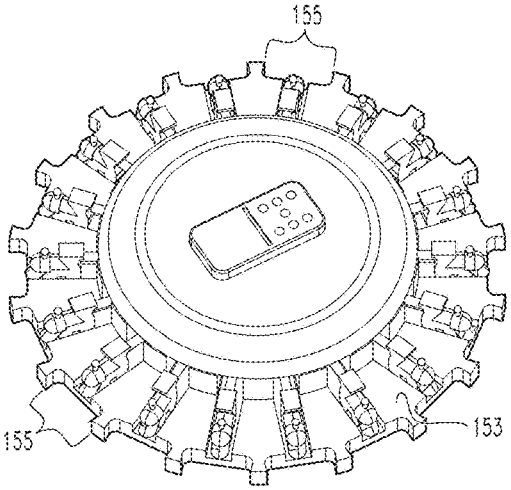
FIG. 7 is a perspective view of the roundhouse assembly of the container of FIG. 1 with top cover engaged.
Figure 8:
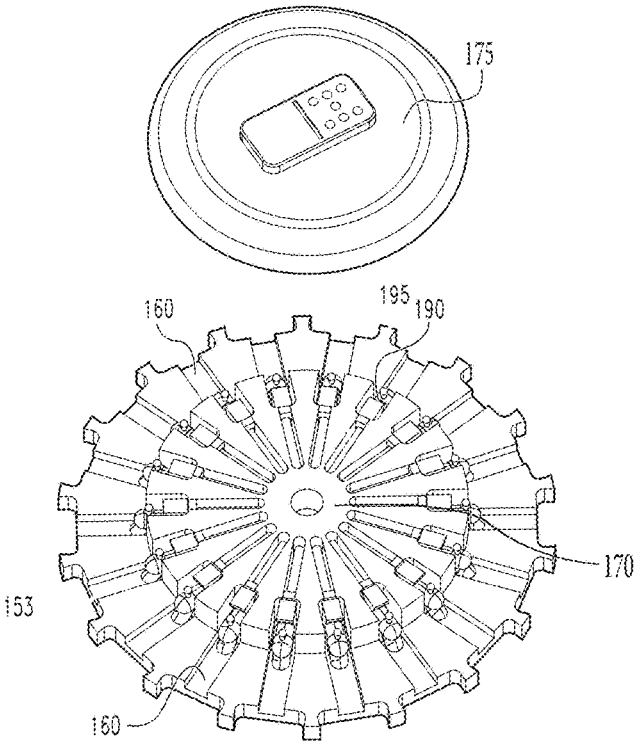
FIG. 8 is a perspective view of the roundhouse assembly of the container of FIG. 1 with top cover disengaged.
Figure 9:
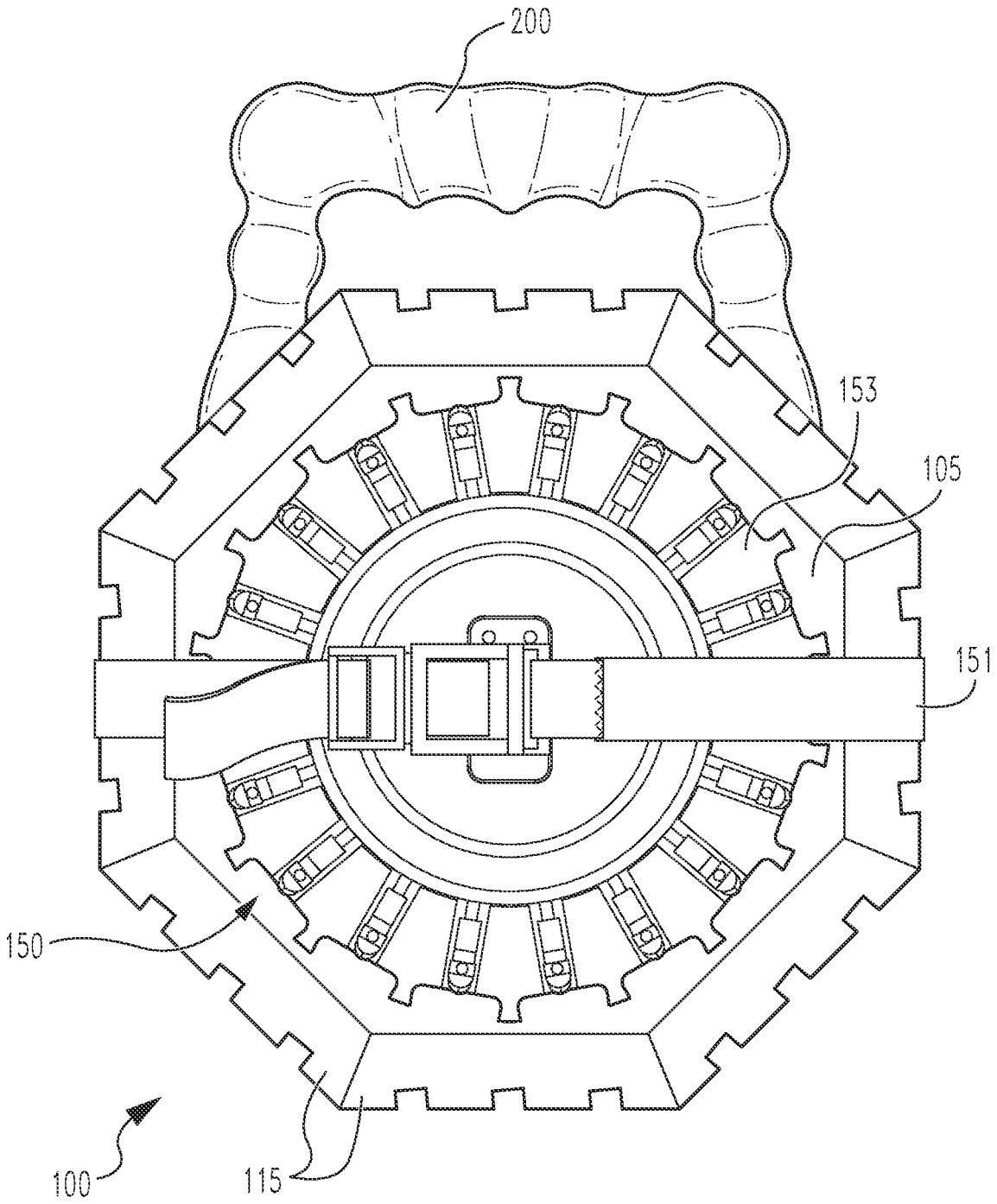
FIG. 9 is a top plan view of the container of FIG. 1 with roundhouse assembly engaged thereto.

For the purposes of promoting an understanding of the principles of the novel technology and presenting its currently understood best mode of operation, reference will now be made to the embodiments illustrated in the drawings and specific language will be used to describe the same. It will nevertheless be understood that no limitation of the scope of the novel technology is thereby intended, with such alterations and further modifications in the illustrated device and such further applications of the principles of the novel technology as illustrated therein being contemplated as would normally occur to one skilled in the art to which the novel technology relates.

Overview of Mexican Train Dominoes

Basic Mexican Train dominoes are played with a standard set of double twelve dominoes, each set with ninety-one dominoes. In addition to the dominoes, the game of Mexican Train requires additional equipment. Most importantly, Mexican Train requires a roundhouse, essentially a hub having a central recess for the starting double and a plurality (typically eight) of equidistantly spaced peripheral slots from which to initiate each respective domino train. In addition to the roundhouse, each train is represented by a token, which is usually an individually colored train engine figurine.

Players play their dominoes in Mexican Train just like they would in regular dominoes—each domino is played so that one end is adjacent the end of a domino already on the table and the two adjacent domino ends match by having the same number of dots. Unless the domino tile is a double, the domino may be placed along either side or the end of the already played end domino so long as the two matching sides are flush. A double may be played adjacent to a matching end of an already played domino, but must be oriented perpendicular to the already played domino. Thus, the train of played dominoes plays out like a train track, twisting and turning across the table.

The game is started by shuffling the dominoes face down, and then each player draws a predetermined number of dominoes, said predetermined number decreasing as the number of players increases (2-4 players take 15 dominoes each, 5-6 players take 12 each, 7-8 players take 10 dominoes each), with the rest of the dominoes remaining in the Boneyard. The roundhouse is placed in the middle of the playing area, with each player claiming a slot as their starting point. The shared Mexican Train is likewise assigned a slot.

The player holding the highest double places his domino in the roundhouse recess to start the game. Then, the player to the immediate left of the starting player takes his turn, followed by the next player, and so on. Each player starts their train by putting a first domino into their slot in the roundhouse, with the end engaging the roundhouse matching the domino in the recess. Players continue extending their trains by adding more dominoes from their hand until they can't play any more. After this first turn, each player may only play one domino on an available train. If a player can play a domino to one of the available trains, their turn is over. If not, the payer draws a domino from the boneyard, and plays it if possible to end their turn. If the player cannot play the boneyard-drawn domino, the player places a marker on the domino at the end of their train to indicate that their train is now open for other players to use. Players may remove a marker on their train by playing one of their own dominos to extend their own train. As in many other games, if a player plays a double, they immediately may take another turn. The game is over when a (winning) player pays his last domino. That player incurs no points against him, while the other players tally up the dots on the dominoes in their respective hands. The over all winner has the lowest cumulative score after a predetermined number of games (usually termed a match) are played. If a player gets rid of all of his dominoes during the first turn, the remaining players are allowed to take their first turn before tallying up their points.

There are a number of game play variants, but the above recitation of the rules gives the gist of the game.

FIGS. 1-11 illustrate a first embodiment of the present invention, a modular carrying case or game kit for playing Mexican Train dominoes. A Mexican train dominoes modular carrying case (also called game kit) 100 is shown including a top member 105, a bottom member 110, and a plurality of side elongated members 115 defining an interior volume 120 for holding dominoes 121. The carrying case 100 typically includes at least one separating member 125 positioned with interior volume 120 to bifurcate the same. Top and bottom members and separating member 105, no, 125 are typically identically shaped, typically thin multi-sided members having regularly shaped faces 127 having a plurality of edges 129, such as hexagons, octagons, dodecagons, or the like. Each edge 129 is typically of equal length. Each respective side member 115 has an exterior face 130 and a generally parallel interior face 135. Exterior face 130 typically includes a plurality of parallel elongated recesses or grooves 131 (for holding dominoes in an orientation visible to a respective player but not the other players) oriented in the direction of elongation, while interior face 135 typically includes a plurality of straight grooves or recesses 137 oriented in a direction perpendicular to the direction of elongation for matingly engaging separation member 125 and one or both of the remaining members 105 to define the box 100.

Each elongated side member 115 is typically a parallelepiped and includes a pair of oppositely disposed elongated side faces 140A, 140B extending between interior and exterior faces 135, 130. Matably engageable fastening member 145A, 145B are operationally connected to each respective elongated side faces 140A, 140B. Fastening member 145A is matingly engageable to fastening member 145B but not to another fastening member 145A. Fastening members 145A, 145B may be opposite poled magnets, a magnet and a ferromagnetic member, hook and loop connectors, or the like. The number of side members 115 is equal to the number of sides defined by the regular shape of the top and bottom members 105, 110.

Generally circular roundhouse assembly 150 is sized to fit over top or bottom member 105, 110 and incudes a generally circular base member 153 defining a plurality of slots 155 equidistantly circumferentially positioned therearound, each slot 155 sized to accept a domino tile. A plurality of respective generally rectangular recesses 160 extend inwardly from each respective slot 155, and a plurality of respective train tokens 165 are operationally connected to extend from a raised central circular dais 170 connected to base member 153 and into each respective slot 160. A circular cap 175 covers the raised dais 170 and includes a rectangular recess 180 sized and shaped to accept a domino. The roundhouse assembly 150 is securable to the top or bottom member 105, 110 during transport, by a connector 151, such as strap or by a fastener pair operationally connected to the bottom or the roundhouse assembly 150 and the top or bottom member 105, 110.

Typically, the interior volume is large enough to hold a double-eighteen set of dominoes, and there are eighteen slots 155 formed in the roundhouse assembly 150, such that eighteen players may be accommodated.

Each train token 165 has a sculpted train portion 190 and an elongated tail member 195 extending therefrom. Each respective elongated tail member 195 is locked into the dais 170, such as by a pin, thickened wedge, or the like, so that the train token 165 is extendable from the dais 170 but not freely disengageable therefrom.

Example

FIGS. 1-11 illustrate an exemplary embodiment of the present novel technology, an octagonal Mexican Train dominoes carrying case 100. As shown in FIG. 1, the case 100 includes octagonal top and bottom members 105, no with eight elongated side members lockingly engaged thereto. Each respective side member 115 is matingly engaged to an edge 129 with the edge 129 engaging a groove 137 in an interference fit. Top, bottom, and separation members 105, no, 125 are thus engaged with each respective side member 115, and adjacent side members 115 are locking engaged with one another via cooperation of fasteners 145A, 145B. Case 100 may be filled with dominoes and domino accessories. Roundhouse assembly 150 is positioned adjacent an exterior face 127 and held in place with a connector 151.

When it is time to play Mexican Train dominoes, connector 151 is disengaged and the roundhouse assembly is set aside. Side members 115 are disengaged to allow access to the dominoes house in the box 100, and dominoes are removed therefrom for play. Each player takes a side member 115 for holding their dominoes in the parallel groves 131. Each player claims a train token 165 and uses the associated slot 160*a* the starting point for their train.

After play, the carrying case 100 is reassembled matingly engaging the eight side members 115 to respective edges 129 of the top, bottom, and separation members 105, 110, 125 and one another. Before the last side member 115 is so engaged, dominoes are placed into the now-defined interior volume 120. Once all side members 115 are engaged with the top, bottom, and side members 105, 110, 125 and one another, the roundhouse assembly 150 is positioned against a box face 129 and fastener 151 is reengaged. Handle 200 is lockingly engaged to grooves 131 of two adjacent side members 115 for ease of carrying.

While the novel technology has been illustrated and described in detail in the drawings and foregoing description, the same is to be considered as illustrative and not restrictive in character. It is understood that the embodiments have been shown and described in the foregoing specification in satisfaction of the best mode and enablement requirements. It is understood that one of ordinary skill in the art could readily make a nigh-infinite number of insubstantial changes and modifications to the above-described embodiments and that it would be impractical to attempt to describe all such embodiment variations in the present specification. Accordingly, it is understood that all changes and modifications that come within the spirit of the novel technology are desired to be protected.

What is claimed is:

1. A game case assembly for Mexican train dominoes, comprising:

an octagonal box portion having eight respective sides and defining an enclosed volume, wherein the box portion further comprises an octagonal bottom member, a spaced octagonal top member, and eight elongated side members, each side member removably connected to the spaced top and bottom members and to two other side members; and a roundhouse portion removably connected to the octagonal box portion;

wherein the roundhouse portion further comprises:

a base member;

a plurality of slots formed equidistantly around the base member;

a raised dais operationally connected to the base member;

a plurality of recesses formed in the base member, each respective recess extending from a respective slot to the dais;

a plurality of elongated train tokens operationally connected to the raised dais, each respective elongated train token extendable into a respective recess; and a cap member covering the dais and having a recess formed therein for accepting a domino;

wherein each respective elongated side member includes a first fastener and an oppositely disposed second fastener;

wherein each first fastener may matingly engage each second fastener;

wherein each first fastener may not matingly engage another first fastener; and wherein each second fastener may not matingly engage another second fastener.

2. The game case assembly of claim 1 wherein a separation member bifurcates the enclosed volume; wherein the separation member is removably connected to each respective elongated side member; and wherein the enclosed volume is at least partially filled with dominoes.

3. The game case assembly of claim 1 wherein each respective elongated side member further comprises oppositely disposed inner and outer surfaces;

a plurality of parallel top grooves disposed on the inner surface for engaging the respective octagonal top member and the octagonal bottom member; and a plurality of parallel bottom grooves disposed on the outer surface for holding dominoes.

4. The game case assembly of claim 1 and further comprising a handle member for lockingly engaging two adjacent elongated side portions.

5. A modular Mexican Train dominoes carrying case, comprising:

a top portion having a plurality of top edges;

a bottom portion having a plurality of bottom edges and spaced from the top portion;

a plurality of elongated side portions operationally connected to the respective spaced top and bottom portions and defining an interior volume, each respective elongated side portion further comprising:

a top surface and an oppositely disposed bottom surface;

a plurality of first elongated grooves formed in the top surface; a plurality of second grooves formed in the bottom surface; first and second oppositely disposed elongated side surfaces;

first and second matable connectors operationally connected to respective first and second elongated side surfaces, wherein each respective first matable connector is removably connectable to each respective second matable connector; and a roundhouse portion removably connected to the top portion; wherein the roundhouse portion further comprises:

a base member;

a plurality of slots formed equidistantly around the base member;

a raised dais operationally connected to the base member;

a plurality of recesses formed in the base member, each respective recess extending from a respective slot to the dais;

a plurality of elongated train tokens operationally connected to the raised dais, each respective elongated train token extendable into a respective recess; and a cap member covering the dais and having a recess formed therein for accepting a domino.

6. The modular Mexican Train dominoes carrying case of claim 5 wherein the top and bottom portions are octagonal and wherein there are eight elongated side portions.

7. The modular Mexican Train dominoes carrying case of claim 5 wherein the top and bottom portions are dodecahedral and wherein there are twelve elongated side portions.

8. The modular Mexican Train dominoes carrying case of claim 5 and further comprising:

a separation portion bifurcating the enclosed volume, wherein the separation portion is removably connected to each respective elongated side portion.

9. The modular Mexican Train dominoes carrying case of claim 5 and further comprising:

a plurality of dominoes disposed in the interior volume.

10. The modular Mexican Train dominoes carrying case of claim 5 and further comprising:

a handle member for lockingly engaging two adjacent elongated side portions.

11. A Mexican Train dominoes kit, comprising:

a top portion having a plurality of top edges;

a bottom portion having a plurality of bottom edges and spaced from the top portion;

a plurality of elongated side portions operationally connectable to the respective spaced top and bottom portions for defining an interior volume, wherein each respective elongated side portion further comprising:

a top surface and an oppositely disposed bottom surface;

a plurality of first elongated grooves formed in the top surface; a plurality of second grooves formed in the bottom surface; first and second oppositely disposed elongated side surfaces;

first and second matable connectors operationally connected to respective first and second elongated side surfaces, wherein each respective first matable connector is removably connectable to each respective second matable connector; a roundhouse portion removably connectable to the top portion;

wherein the roundhouse portion further comprises:

a base member;

a plurality of slots formed equidistantly around the base member;

a raised dais operationally connected to the base member;

a plurality of recesses formed in the base member, each respective recess extending from a respective slot to the dais;

a plurality of elongated train tokens operationally connected to the raised dais, each respective elongated train token extendable into a respective recess; and a cap member covering the dais and having a recess formed therein for accepting a domino;

a plurality of dominoes; and a handle portion for lockingly engaging one or more respective first elongated groove.

* * * * *